United States Patent [19]

Dausey et al.

[11] Patent Number: 4,831,903

[45] Date of Patent: May 23, 1989

[54] CLOSE QUARTERS MULTI-ANGLE PIPE WRENCH

[76] Inventors: George M. Dausey, Rte. 1, Box 125, Linkwood, Md. 21835; Raymond B. Barrett, 106 E. Point Dr., Savannah, Ga. 31410

[21] Appl. No.: 207,833

[22] Filed: Jun. 17, 1988

[51] Int. Cl.[4] ..... B25B 13/16

[52] U.S. Cl. ..... 81/165

[58] Field of Search ..... 81/92, 94–103, 81/111, 117, 129, 129.5, 150, 151, 155–158, 165, 170, 175, 176, 177.1, 177.8, 177.2, 177.85

[56] References Cited

U.S. PATENT DOCUMENTS

| | | |
|---|---|---|
| 525,684 | 9/1894 | Friede . |
| 620,485 | 2/1899 | McCune . |
| 621,869 | 3/1899 | Stynsberg . |
| 924,269 | 6/1909 | Paterson . |
| 1,405,432 | 2/1922 | Peterson . |
| 1,747,360 | 7/1929 | Giles . |
| 2,649,824 | 9/1949 | Maxwell . |
| 2,825,254 | 4/1957 | Peltcher . |
| 3,948,120 | 4/1976 | Hancock . |

*Primary Examiner*—Debra Meislin

*Attorney, Agent, or Firm*—David H. Semmes

[57] ABSTRACT

Pipe wrenches, particularly a pipe wrench which has a removable pull handle, such that the wrench can make four 90° turns in close quarters. The wrench is characterized by a housing having a stationary lower gripping jaws, an upper clamping jaw housing pivoted to the lower gripping jaw and including an adjustable clamping jaw. Intersecting vertical and horizontal bores extend through the gripping jaw housing, such that a pull handle may be removably inserted therein.

8 Claims, 2 Drawing Sheets

CLOSE QUARTERS MULTI-ANGLE PIPE WRENCH

CROSS-REFERENCES TO RELATED APPLICATIONS

None.

BACKGROUND OF THE INVENTION (1) Field of the Invention:

Pipe wrenches, particularly a close quarters multi-angle wrench including a vertically displaceable upper clamping jaw and a lower stationary gripping jaw. The wrench housing is provided with intersecting pull handle bores and a separate pull handle which may be fitted into either bore, such that the wrench can make four 90° turns in close quarters.

2. Description of the Prior Art:

FRIEDE, 525,684; McCUNE, 620,485; STYNSBERG, 621,869; PATERSON, 924,269; PETERSON, 1,405,432; GILES, 1,747,360; MAXWELL, 2,649,824; PELTCHER

SUMMARY OF THE INVENTION

A close quarters multi-angle pipe wrench including an angular housing having a vertically extending shank and a horizontally extending, stationary lower gripping jaw. A vertical bore extends through the shank and a horizontal bore extends through the lower gripping jaw, so as to intersect the vertical bore.

An upper clamping jaw housing is pivoted in its lower portion to the lower gripping jaw and includes a vertically extending inner shank having a vertical key way defined therein, and an upper gripping jaw adjustably supported within the key way so as to be parallel with the lower gripping jaw. A removable pull handle is adjustably, complementally engagable with both the vertical bore and the horizontal bore as a removable lever for wrenching the angular housing and thus the clamping jaws in close quarters.

DESCRIPTION OF THE PREFERRED EMBODIMENTS

Figure 1:
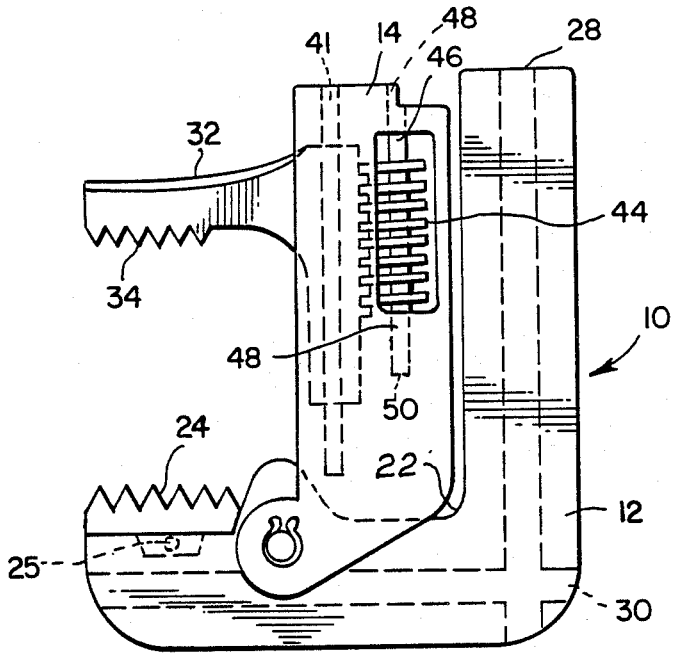
FIG. 1 is a side elevation (partially in phantom) of the close quarters multi-angle wrench.
Figure 2:
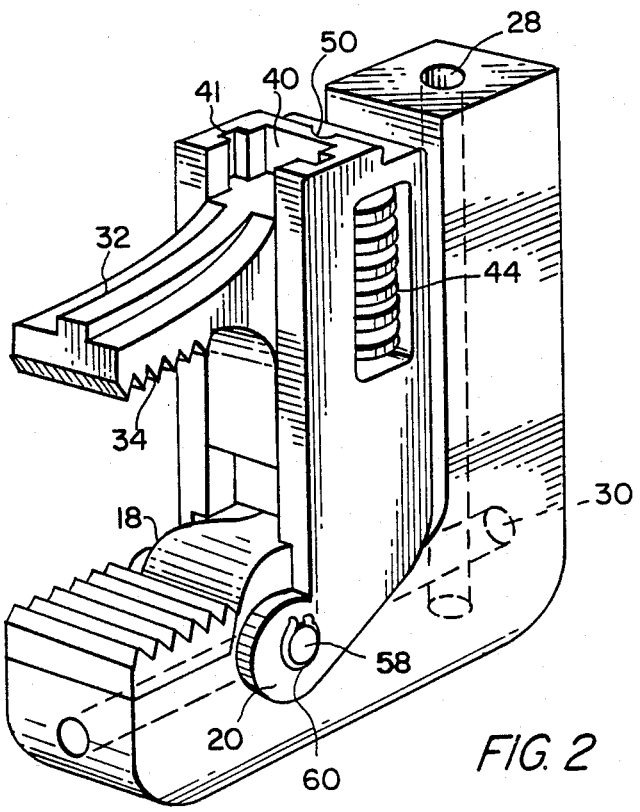
FIG. 2 is a perspective view.

In FIG. 1, a close quarters multi-angle wrench 10 is illustrated as comprising angular housing 12 and an upper clamping jaw housing 14 pivoted in its lower portion by means of pivot pin 58 extending through lower gripping jaw portion 60. Angular housing 12 is provided with vertical bore 28 extending through the shank and a horizontal bore 30 extending through the lower gripping jaw portion 60, so as to intersect vertical bore 28.

Figure 3:
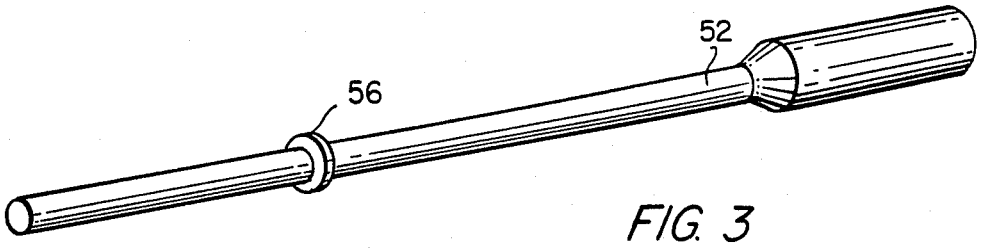
FIG. 3 is a perspective view of the round pull handle.

As illustrated in FIG. 3, round pull handle 52 may include a stop ring 56 so as to limit the penetration of pull handle 52 within bores 28, 30. Clamping jaw housing 14 includes a vertical key way 40 having lateral extensions 41 engagable with corresponding lateral extensions 42 defined on the sides of adjustable upper gripping jaw 32. The adjustable upper clmaping jaw 32 includes, also, inner threads 36 exposed to the inner aperture defined in the clamping jaw housing. As will be apparent, upper clamping jaw 32 includes downwardly extending gripping teeth 34 supported in parallel with lower gripping jaw teeth 24. Retainer or pivot pin 25 may be provided for removable support of teeth 24.

A knurled adjusting nut 44 is positioned upon shaft 46 extending through bore 48 and seated by means of threads 50 defined in the clamping jaw housing. Shaft 46 may be slotted at its top for ease of securement. Manifestly, the upper clamping jaw inner threads 36 complementally engage the knurled nut threads 44, such that the vertical position of upper clamping jaw 32 may be adjusted with respect to lower gripping jaw teeth 24, in accommodating pipes or nuts of varying diameter.

Figure 4:
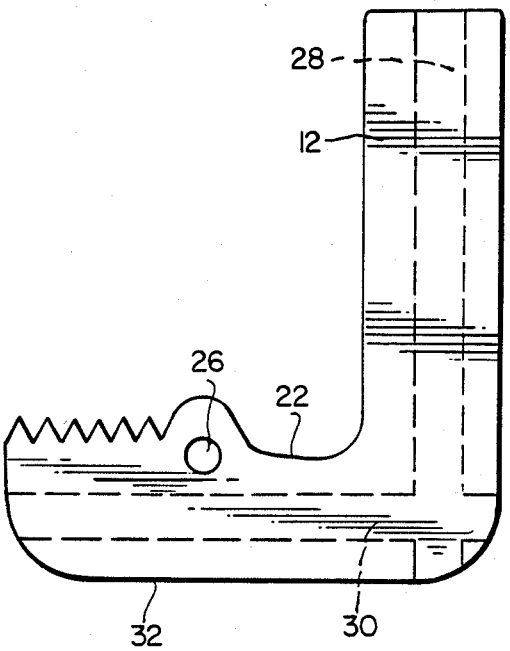
FIG. 4 is a side elevation of the angular housing.
Figure 5:
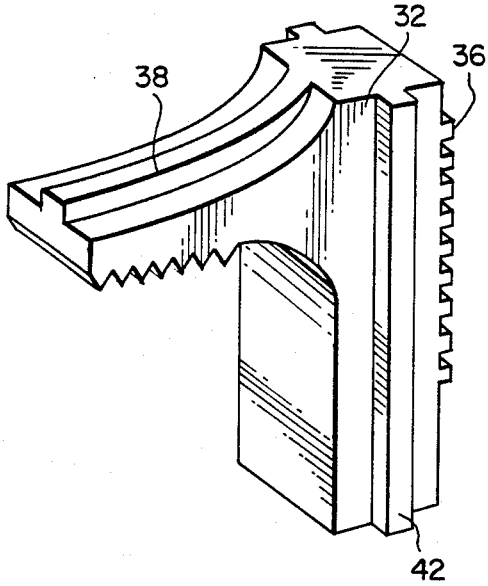
FIG. 5 is a perspective view of the upper clamping jaw.
Figure 6:
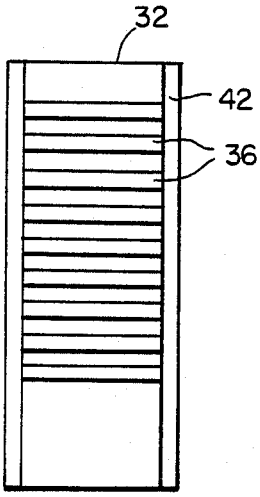
FIG. 6 is an end elevation of the upper clamping jaw illustrating the angled threads which are complementally engagable with the knurled adjusting nut threads.

As illustrated in FIGS. 1 and 4, angular housing 12 includes a lower rounded seat 22 with rounded end 18 which serves as a fulcrum for a corresponding curvate seat defined in upper clamping jaw bifurcated portion.

As will be apparent, the close quarters multi-angle pipe wrench thus provides tighter wrench action due to the pivoting of the vertically displaceable upper clamping jaw with respect to the lower gripping jaw. Once the wrench is adjusted and in place with an obstruction or obstructions near at hand, pull handle 52 may be inserted into vertical bore 28 or horizontal bore 30 at either end and torque applied to tighten or loosen a pipe, rod or nut within its capacity. As torque is applied, the three remaining openings of bores 28, 30 rotate in such a manner as to expose one or more bore openings, once the wrenching action is stopped. Thus, 360° rotation is provided without the use of a costly ratcheting mechanism or the need to physically remove the wrench head from the object being tightened.

As such, the multi-angle pipe wrench rotates within a smaller diameter and may be tightened or loosened easily. The simple and progressive clamping action insures that the harder the pull, the tighter the clamp.

Manifestly, various configurations of angular housing and gripping jaws may be employed without departing from the scope of the present invention.

We claim:

1. A close quarters multi-angle head wrench comprising:

(a) an angular housing including a vertically extending shank, having a horizontally extending lower gripping jaw, a vertical bore extending through said shank and a horizontal bore extending through said lower gripping jaw so as to intersect said vertical bore; and (b) an upper clamping jaw housing pivoted in its lower portion to said lower gripping jaw and including:

(i) a vertically extending inner shank having a vertical key way defined therein, and (ii) an upper gripping jaw adjustably supported within said key way, so as to be parallel with said lower gripping jaw.

2. A close quarters multi-angle pipe wrench comprising:

(a) an angular housing including a vertically extending shank, having a horizontally extending lower gripping jaw, a vertical bore extending through said shank and a horizontal bore extending through said lower gripping jaw so as to intersect said vertical bore;

(b) an upper clamping jaw housing pivoted in its lower portion to said lower gripping jaw and including:

(i) a vertically extending inner shank having a vertical key way defined therein, and (ii) an upper gripping jaw adjustably supported within said key way, so as to be parallel with said lower gripping jaw; and (c) a removable pull handle selectively complementally engagable with the vertical bore or the horizontal intersecting bore, so as to serve as a lever for wrenching said angular housing and, thus, said clamping jaws in close quarters.

3. A close quarters multi-angle pipe wrench as in claim 2, said angular housing including an inner seat defined within a portion of said lower gripping jaw adjacent said vertical shank, as a fulcrum for complemental engagement with the lower surface of the said upper clamping jaw housing.

4. A close quarters multi-angle pipe wrench as in claim 2, said upper clamping jaw housing including an inner adjusting aperture and a knurled nut positioned upon a shaft extending through said aperture, said upper gripping jaw including an inner threaded portion extending beyond said key way and into said adjusting aperture so as to engage said knurled nut.

5. A close quarters multi-angle pipe wrench as in claim 4, said upper clamping jaw housing including a bifurcated lower portion extending over each side of said lower gripping jaw such that said clamping jaw housing complementally engages said lower gripping jaw.

6. A close quarters multi-angle pipe wrench as in claim 5, including a retainer pin extending through said bifurcated lower portion of said clamping jaw housing and said gripping jaw.

7. A close quarters multi-angle pipe wrench as in claim 6, said clamping jaw housing having a convex bottom surface defined between said bifurcated portion and complementally engagable with said inner seat of said lower gripping jaw.

8. A close quarters multi-angle pipe wrench as in claim 7, said lower gripping jaw including a serrated, angled gripping surface removably supported within said lower gripping jaw.

* * * * *